United States Patent [19]

Okitsu et al.

[11] 4,164,208

[45] Aug. 14, 1979

[54] EXHAUST GAS RECIRCULATION MEANS

[75] Inventors: Kingo Okitsu; Koji Asanomi; Setsuo Harada; Yasunori Takemoto, all of Hiroshima, Japan

[73] Assignee: Toyo Kogyo Co., Ltd., Hiroshima, Japan

[21] Appl. No.: 808,354

[22] Filed: Jun. 20, 1977

[30] Foreign Application Priority Data

Jun. 19, 1976 [JP] Japan ..... 51-72328
Jun. 22, 1976 [JP] Japan ..... 51-75050

[51] Int. Cl.[2] ..... F02M 25/06
[52] U.S. Cl. ..... 123/119 A
[58] Field of Search ..... 123/119 A

[56] References Cited

U.S. PATENT DOCUMENTS 3,872,845 3/1975 Schultz ..... 123/119 A
4,041,913 8/1977 Nohira ..... 123/119 A
4,047,509 9/1977 Arnund ..... 123/119 A

*Primary Examiner*—Wendell E. Burns
*Attorney, Agent, or Firm*—Wenderoth, Lind & Ponack

[57] ABSTRACT

An exhaust gas recirculation device in which exhaust gas from the engine of a vehicle, for example, may be recirculated via two separate lines to portions of a carburetor which are upstream and downstream of a throttle valve, to permit a suitably large amount of exhaust gas to be recirculated when necessary and which includes control means which stops the flow of gas in both lines when the engine is being warmed up, and stops the flow of gas in the upstream recirculation line only when engine load, engine speed, or vehicle speed is high, or when there is a risk of icing in the carburetor, whereby the disadvantages of recirculated exhaust gas during particular engine operating conditions are avoided.

4 Claims, 6 Drawing Figures

EXHAUST GAS RECIRCULATION MEANS

BACKGROUND OF THE INVENTION

The present invention relates to an exhaust gas recirculation system for an internal combustion engine of an automotive vehicle. More particularly, the invention relates to an exhaust gas recirculation system in which the amount of recycled exhaust gas may be varied in response to operating conditions including engine speed, load conditions, warm-up conditions, vehicle speed, and temperature of intake air.

A known technique for reduction of emission of pollutants, particularly nitrogen oxides, in the exhaust gases of an internal combustion engine which are discharged to the atmosphere is to recycle a portion of the exhaust gases to a stage preceding the combustion stage, usually to the carburetor.

In a means according to one conventional approach, the air-fuel mixture is made leaner or richer than the theoretical air-fuel ratio of 15, at which nitrogen oxide emission is a maximum, and a comparatively small amount of exhaust gas is recirculated. However, there are definite limits to the amount of reduction of $NO_x$ emission that can be achieved by such a means.

To provide increased control of $NO_x$ emission in order to meet the requirements of government or other regulations without having an excessively adverse effect on average engine operating conditions, it has therefore been proposed to set the air-fuel ratio at the theoretical ratio and to greatly increase the amount of recirculated exhaust gas.

To achieve recirculation of the desired large amounts of exhaust gas it has been proposed to introduce the recirculated gas into a carburetor via separate ducts which are upstream and downstream of the throttle valve in the carburetor, i.e., upstream and downstream in terms of air flowing through the carburetor, and, in order to maintain the ratio of recirculated exhaust gas to the air-fuel intake more or less constant over the range of moderately low to moderately high load conditions for the engine to make the upstream supply of recirculated exhaust gas proportional to the air intake and the downstream supply proportional to the pressure downstream of the venturi section of the carburetor. In conventional means, control of the flow rates of recirculated exhaust gas is effected simply by orifices, and the large amount of exhaust gas recirculated by conventional means is very disadvantageous in certain operating conditions. In particular, (1) Recirculation of a large amount of exhaust gas when the engine is rotating at high speed or is operating under a high load, or when vehicle speed is high, inevitably leads to reduced engine output and/or increased fuel consumption rates;

(2) Depending on temperature conditions within and around the carburetor, the contribution to a temperature increase made by exhaust gas recirculated to the upstream portion of the carburetor can be the cause of undesirable heating of the fuel float chamber, with consequent percolation and escape of fuel. Alternatively, depending on ambient temperature conditions and relative humidity of the intake air, recirculated exhaust gas, which has a high moisture content, may be the cause of icing in the carburetor.

To summarize, conventional means do not really consider relating the main problem to exhaust gas recirculation, namely how to recirculate the gas when definite advantages are achieved thereby, but stop recirculation of the gas the advantages are largely or completely outweighed by disadvantages relating to other aspects of engine operation.

SUMMARY OF THE INVENTION

The present invention solves this problem by providing an exhaust gas recirculation means in which exhaust gas may be recirculated into the carburetor of an internal combustion engine via two ports, one upstream of and the other downstream of a throttle valve in the carburetor, and in which recirculation lines leading to these ports are closed by the action of valve elements controlled by a control unit, for example, an electrical or electronic control unit, which receives input indicative of engine speed, vehicle speed or engine load and which acts through the valve elements to close only the recirculation line leading to the upstream portion of the carburetor when the engine or vehicle speed and/or engine load exceeds a set value, whereby the rates of exhaust gas recirculation are automatically adjusted to optimum values for the complete range of engine operating conditions. In a preferred embodiment, the control unit receives input indicative of the air intake temperature and/or input indicating when the engine is warmed-up, and acts through the valve elements to close only the recirculation line leading to the upstream portion of the carburetor when the intake air temperature falls below a set value, and to close both recirculation lines during warm-up of the engine.

BRIEF DESCRIPTION OF THE DRAWING

A better understanding of the invention may be had from the following full description thereof when read in reference to the attached drawings, in which like numbers, refer to like parts, and in which.

DETAILED DESCRIPTION OF THE INVENTION

Figure 1:
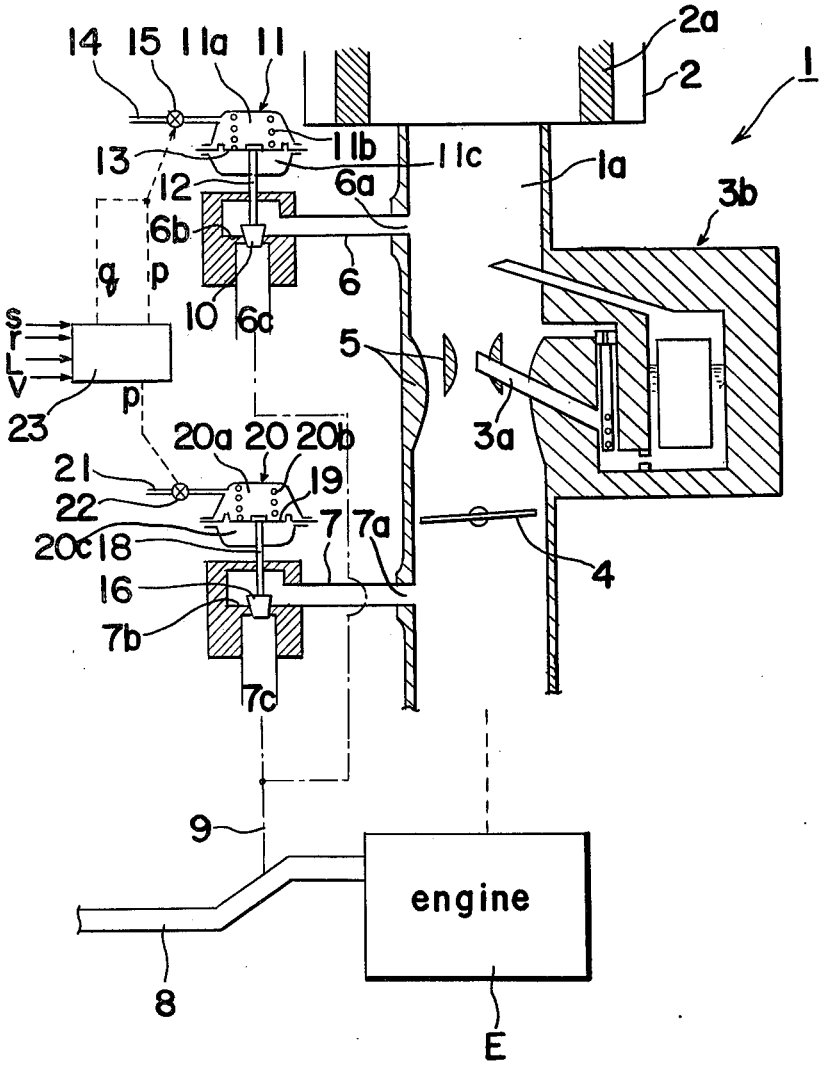
FIG. 1 is a schematic cross-sectional view showing the main features of an exhaust gas recirculation means according to a first embodiment of the invention.

Referring to FIG. 1, there is shown a carburetor 1 comprising an air intake circuit 1*a* which leads to a venturi section 5, a main nozzle 3*a* providing communication between a fuel float system 3*b* and the venturi section 5, and a throttle valve 4 downstream of the venturi section 5, i.e., on the opposite side of venturi section 5 from the air intake circuit 1*a*, and which produces an air-fuel mixture in a conventionally known manner and supplies the mixture to be burned in one or more combustion chambers of an engine, indicated schematically at E. The carburetor 1 may include other conventionally known elements such as a choke valve, an idle port, and a low speed port, not shown. In terms of air flow into the carburetor 1, the air intake circuit 1*a* is preferably preceded by an air cleaner 2 comprising a filter 2*a*. Gases produced by combustion of the mixture are exhausted from engine E through an exhaust pipe 8 and a portion thereof is taken off from the exhaust pipe 8 by take-off line schematically indicated at 9 and supplied by line 9 into the intake ends 6*c* and 7*c* of a first recirculation line 6 and a second recirculation line 7, respectively, lines 6 and 7 being separate from each other and connected to separate branch lines of take-off line 9.

The first recirculation line 6 forms part of a first exhaust gas recirculation means and has a delivery end 6*a* which opens into a portion of carburetor 1 which is upstream of throttle valve 4 and, in this embodiment, is upstream of venturi section 5 also. Flow of exhaust gas through the recirculation line 6 can be throttled or completely stopped by a first flow control valve 10 which is seated on a valve seat 6*b* defined by wall portions of the recirculation line 6 and the degree of opening of which is controlled by a diaphragm 13 through a rod 12 having one end attached to the first flow control valve 10 and the opposite end connected to one side of the diaphragm 13 extending across a first diaphragm unit 11. The portion of the diaphragm unit 11 which is in part bounded by the side of the diaphragm 13 to which the rod 12 is connected is sealed or connected to a constant pressure source and constitutes a constant pressure chamber 11*c*. The portion of the diaphragm unit 11 which is on the opposite side of the diaphragm 13 constitutes a negative pressure chamber 11*a* which is connected through a first control fluid duct 14 to a suitable negative pressure source, for example, a portion of the intake air flow to carburetor 1 which is at reduced pressure. In the control fluid duct 14 there is provided a first stop valve 15 which is controlled in a manner described below by a control unit 23. In the negative pressure chamber 11*a* there is provided a coil spring 11*b* which acts on the flow control valve 10 via the diaphragm 13 and the rod 12 and constantly exerts a force on the control valve 10 urging it towards the valve seat 6*b*. Assuming that the stop valve 15 is open, the diaphragm 13 moves against the force of spring 11*b*, due to the force exerted as a result of the difference of pressures in chambers 11*a* and 11*c*, and the control valve 10 is opened to a degree dependent on the amount of movement of the diaphragm 13, and exhaust gas is allowed to flow through the recirculation line 6 into the carburetor 1. By connecting the control fluid duct 14 to a source the pressure of which is proportional to air flow in the carburetor 1, the movement of the diaphragm 13, and, hence the opening of the flow control valve 10 and the rate of flow of the exhaust gas into the carburetor 1, are varied in accordance with conditions in the carburetor 1, i.e., in accordance with engine operating conditions. When the stop valve 15 is closed, the difference between the pressure in the chamber 11*a* and the pressure in the chamber 11*c* of the diaphragm unit 11 becomes insufficient to counter the force of the spring 11*b*, which therefore seats the flow control valve 10 on the valve seat 6*b*, thereby interrupting the supply of the exhaust gas to the delivery end 6*a* of the recirculation line 6.

Still in FIG. 1, the exhaust gas supplied into the second recirculation line 7 is supplied via the delivery end 7*a* of the line 7 into a portion of the carburetor 1 which is downstream of the throttle valve 4. The recirculation line 7 forms part of a second recirculation system that has basically the same construction and manner of functioning as the abovedescribed first exhaust gas recirculation system and comprises a second flow control valve 16 which is seatable on a valve seat 7*b* defined by wall portions of the line 7 and which controls the flow of the exhaust gas in the line 7, a second diaphragm unit 20 divided into a negative pressure chamber 20*a* and a constant pressure chamber 20*c* by a diaphragm 19 which acts through a rod 18 to control the position of the flow control valve 16, a coil spring 20*b* provided in the negative pressure chamber 20*a* and exerting a constant force tending to cause the diaphragm 19 to seat the flow control valve 16 on the valve seat 7*b*, whereby the flow of the exhaust gas in the line 7 is stopped, a second control fluid duct 21 which connects the negative pressure chamber 20*a* of the diaphragm unit 20 to a suitable negative pressure source, and a second stop valve 22 which is controlled by the control unit 23 and is actuable to open and close the control fluid duct 21 selectively.

Needless to say, instead of connected to a negative pressure source, the control fluid duct 14 and/or the control fluid duct 21 may be connected to a positive pressure source, in which case the spring 11*b* and/or the spring 20*b* is provided on the other side of the diaphragm of the corresponding diaphragm unit.

The control unit 23 is suitably an electrical or electronic unit, which is not necessarily positioned adjacent to the carburetor 1 in the manner shown in FIG. 1, and which receives input signals s, r, L, and v. The input signal s indicates that engine E is warming up, and can be supplied, for example, from a switch actuated by a device which detects the temperature of cooling water in the engine E. The input signal r relates to the engine speed and can be supplied by any suitable device responsive to engine rotation. The input signal L indicates that the engine load is above a certain set level, and is supplied, for example, from an element which compares the pressure of intake air with the pressure of air ambient to the engine or from a position of the throttle valve. The input signal v indicates that the vehicle speed is above a certain set level, and is suitably supplied from an element which measures or computes rotary or peripheral speed of any one of the wheels of the vehicle driven by engine E. Needless to say, the various elements providing such input signals to control unit 23 can be associated with or provided on branch lines connecting to elements which supply signals for display on a driving dashboard, i.e., the invention does not necessarily require provision of supplementary detection elements in an automotive vehicle.

In response to these input signals, the control unit 23 supplies as an output a signal p causing the stop valve 15 and the stop valve 22 to close when the warming up signal s is received, and a signal q to close only the stop valve 15 when any one of the signals r, L, or v is received, the stop valve 22 otherwise being left open. This action is achieved by providing in the control unit 23 an output terminal which is connected directly to an input terminal for the signal s and supplies an output to close the valve 22, and an OR circuit the output terminal of which is connected to close the valve 15 and which receives all the signals s, r, L and v as an input, for example. The stop valves 15 and 22 may be any type of valve that is actuable by electrical signals, for example, solenoid-controlled valves.

By this action, therefore, recirculation of the exhaust gas is completely stopped during warm-up of engine E and, when suitable running conditions have been achieved, the exhaust gas is recirculated via both lines 6 and 7, but recirculation of excessive amounts of exhaust gas during high engine speed conditions or at high vehicle speed is avoided by closure of the recirculation line 6 when these conditions are attained.

Figure 2:
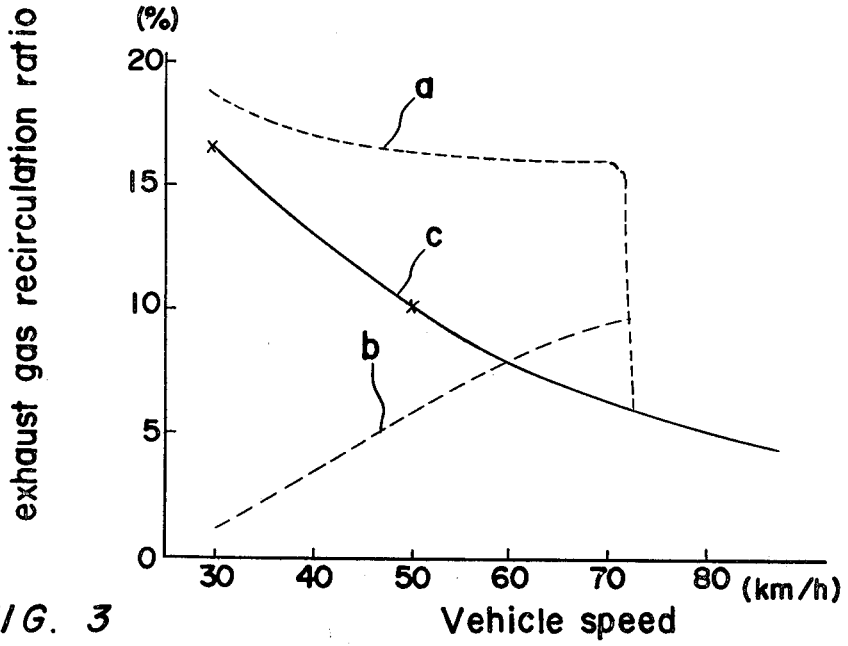
FIG. 2 is a graph showing the relation of exhaust gas recirculation to vehicle speed in the means of FIG. 1.

Results obtained by the means of the invention are illustrated in the graph of FIG. 2 to which reference is now had, and in which the abscissa shows values of vehicle speed, determined directly or on the basis of engine speed, and the ordinate shows values of the exhaust gas recirculation ratio, defined as the amount of recirculated exhaust gas divided by the intake fuel-air mixture and multiplied by 100. The curve a shows the overall recirculation ratio, the curve b the recirculation ratio of the exhaust gas supplied to the upstream portion of the carburetor 1 by the recirculation line 6, and the curve c the recirculation ratio of the exhaust gas supplied to the downstream portion of the carburetor 1 by the recirculation line 7.

Because of the respective locations of the delivery ends 6*a* and 7*a* of the first and second recirculation line 6 and 7, the upstream supply of recirculated exhaust gas tends to increase proportionally to the increased air intake which accompanies increased vehicle or engine speed, whereas the flow of the recirculated exhaust gas via the recirculation line 7 is greatly influenced by the negative pressure downstream of the throttle valve 4 and, therefore, tends to decrease as the vehicle speed increases. The net result is that, in the range of speed of about 30–70 km/h the recirculation ratio of the total amount of exhaust gas supplied into the carburetor 1 via the recirculation lines 6 and 7 remains generally constant at a value somewhat higher than 15%. When the vehicle speed reaches about 70 km/h, the signal v is supplied to the control unit 23 and, consequently, the recirculation ratio drops rapidly to a value of about 4 to 6%. This lowering of recirculation ratio is effected to prevent engine output from falling and to reduce the fuel consumption ratio.

Figure 3:
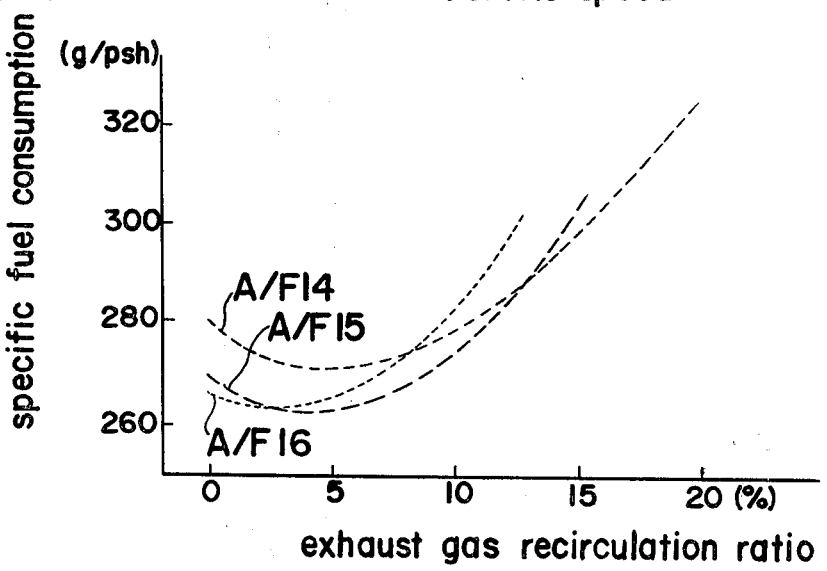
FIG. 3 is a graph showing the relation of specific fuel consumption to the exhaust gas recirculation ratio in the means of FIG. 1.

Reference is now had to FIG. 3, which shows the relation achieved by the means of the invention between the exhaust gas recirculation ratio and the specific fuel consumption when the air-fuel ratio of the mixture produced in the carburetor 1 is 14, 15, and 16 and the engine speed and the mean effective output pressure Pe are maintained constant at 1,500 rpm and 3 $kg/cm^2$, respectively. It is seen that, for all three air-fuel ratios, the fuel consumption is minimum when the recirculation ratio is in the vicinity of 5%.

It is thought that the reason for minimum fuel consumption for the recirculation ratio of about 5% is as follows. In an engine in which an Otto cycle is repeatedly effected, the thermal efficiency is influenced by the ratio of the specific heat of components of a mixed gas, in this case, the air-fuel mixture and recirculated exhaust gas, and the pressure inside the cylinder defining the combustion chamber at the start of the compression stroke. However, since a change in the ratio of the specific heat of the gas mixture components between times when the exhaust gas is recirculated and the exhaust gas is not recirculated is very small, for example, on the order of 1.38:1.40, which may be ignored for practical purposes, the thermal efficiency is directly governed by the pressure in the cylinder, that is, by the amount of recirculated gas and, theoretically, from this point of view, the thermal efficiency should improve as the amount of recirculated exhaust gas is increased. However, since the recirculated exhaust gas is comparatively inert, it tends to lower the speed of combustion, which off-sets the advantage of the increased pressure in the cylinder due to the gas. The net result of these mutually cancelling factors is that maximum thermal efficiency is achieved when the exhaust gas recirculation ratio is in the range of 5 to 10%.

Comparing FIG. 2 and FIG. 3, it is seen that the system of the invention offers the considerable advantage that a minimum specific fuel consumption is achieved when high vehicle speeds are reached.

Figure 4:
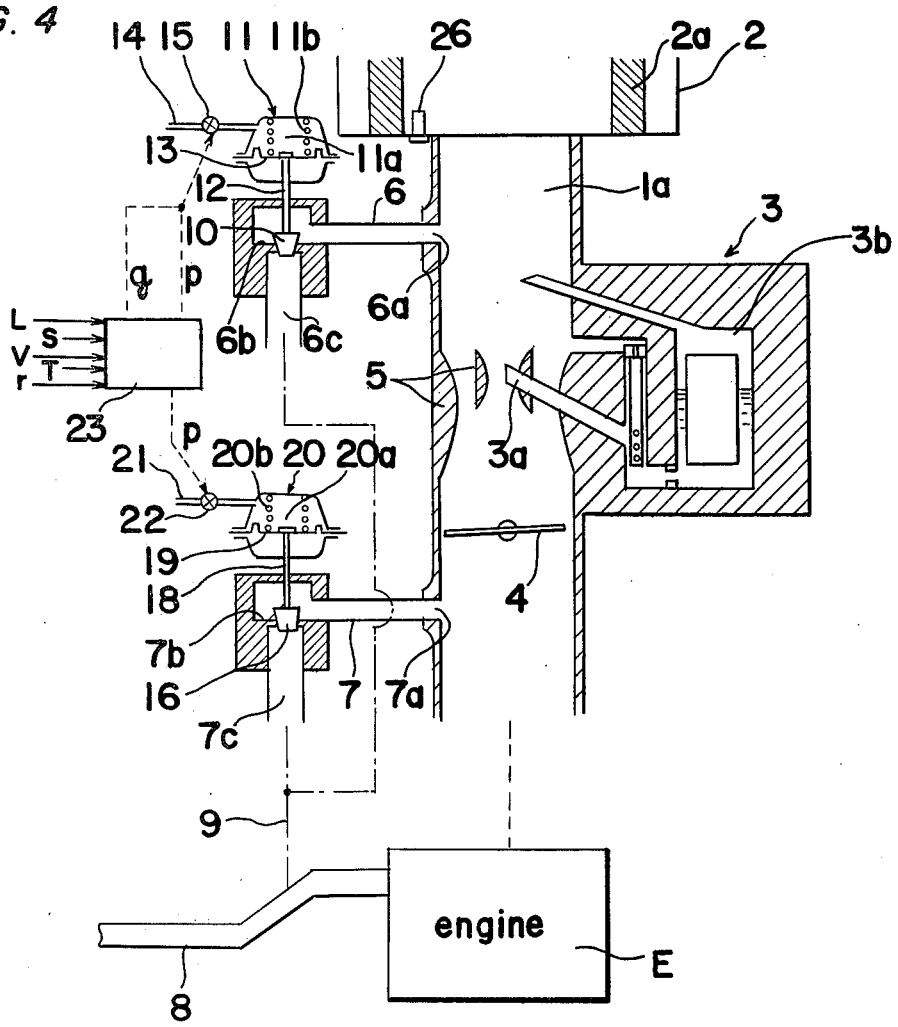
FIG. 4 is a view similar to FIG. 1 and showing another embodiment of the invention.

Reference is now had to FIG. 4 which shows another embodiment of the invention in which a control unit 23 further receives, in addition to the signals received in the embodiment of FIG. 1, a signal T indicating that the temperature of air in the air intake air portion of the carburetor 1 is below a certain temperature, and other parts are same as in FIG. 1. The signal T may be supplied, for example, by a bimetallic element or other suitable means constituting a temperature detector 26 which is mounted on the filter 2*a* adjacent to the inlet of the carburetor 1, and has associated therewith a suitable circuit (not shown) for transmission of signals to the control unit 23.

Figure 5:
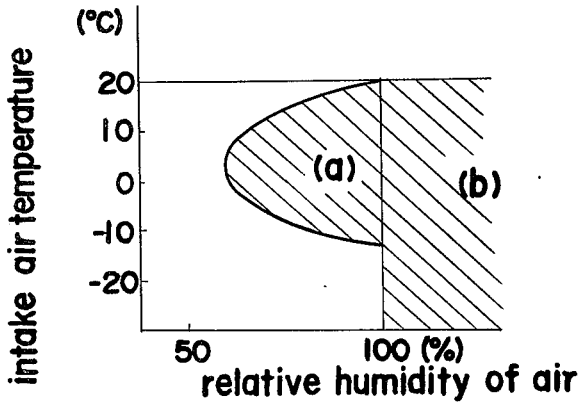
FIG. 5 is a graph showing the relation of icing in a carburetor to intake air temperature and relative humidity of the air in a carburetor.

Referring to the graph of FIG. 5, the abscissa represents values of relative humidity of intake air and the ordinate represents values of the temperature thereof. In the absence of the recirculated exhaust gas admixed therewith, the intake air is practically never in a supersaturated state in which the relative humidity is greater than 100%. The region in which icing is liable to occur is that bounded by the generally-paraboric curve (a) in the drawing, in which the relative humidity is in the range 50–100% and temperature centers on a value of 3°–5° C. and extends to an upper limit of 20° C. and to a lower limit of close to −15° C. These temperatures noted for the intake air are, of course, influenced to a considerable extent by the temperature of the engine as a whole, and are somewhat higher than the external ambient air temperature. The reason for the upper limit of 20° C. is that, even supposing a certain amount of lowering of temperature of air subsequent to intake thereof due to the latent heat of vaporization, temperatures reached are not such as to permit icing. On the other hand, if the temperature of the intake air is in the vicinity of or lower than about −15° C., although air temperature is favourable to icing, the absolute moisture content of the air is so low that the quantity of ice which may form is insufficient to have any practical effect on the functions of the carburetor. The system of the invention makes no contribution to avoidance of icing in the region bounded by the curve (a) of FIG. 5.

With the addition of the upstream recirculated exhaust gas, however, the relative humidity of the air-fuel mixture in the intake portion of the carburetor readily becomes higher than 100% and icing may occur over the whole range of intake air temperature from below −20° C. to +20° C. In this respect, the system of the invention offers a definite advantage since the supply of the recirculated exhaust gas via the recirculation line 6 is interrupted when the temperature of the intake air is in the range in which admixture of the exhaust gas therewith is liable to cause icing. For the above noted reason, 20° C. is the upper limit of this range, and the temperature detector is therefore preferably made such that a signal T is supplied continuously to the control unit 23 while the intake air temperature is lower than 20° C., but is not supplied when air intake temperature is 20° C. or higher.

Figure 6:
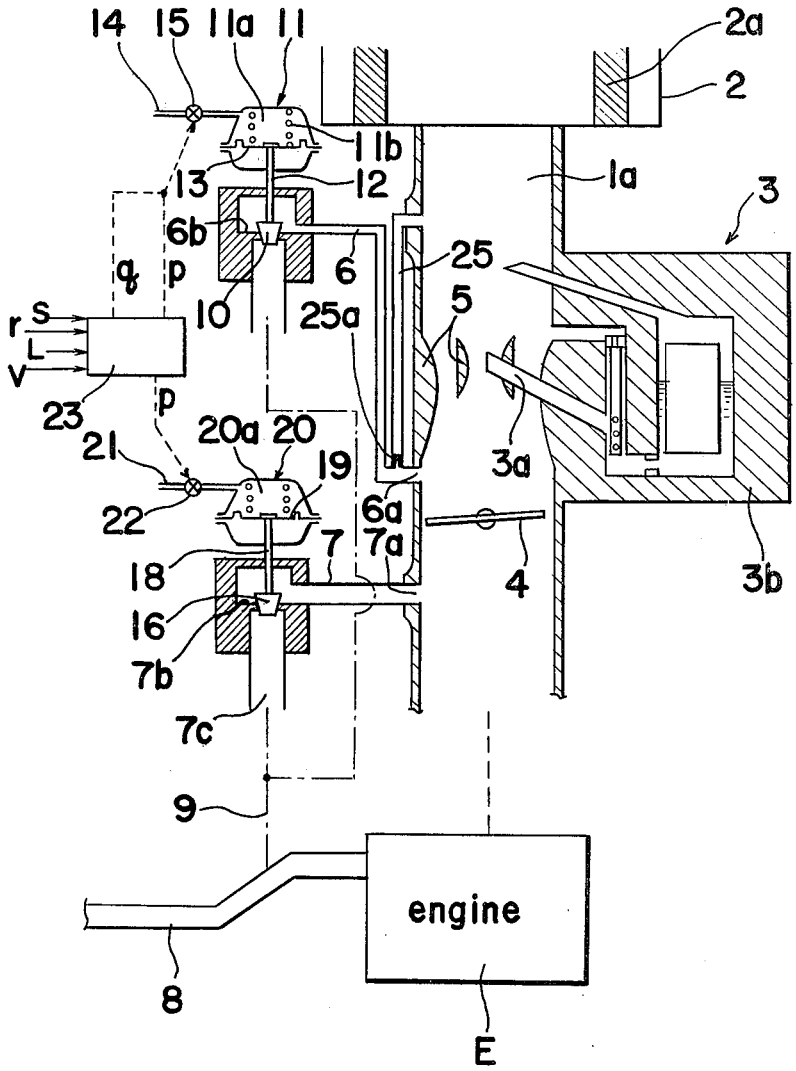
FIG. 6 is a view similar to FIG. 1 and showing another embodiment of the invention.

Referring now to FIG. 6, there is shown another embodiment of the invention in which the delivery end 6*a* of the recirculation line 6 opens into a portion of the carburetor 1 which is intermediate the venturi section 5 and throttle valve 4 and is also in communication with the delivery end of a supplementary air duct 25, the intake end of which opens into a portion of the carburetor 1 upstream of the venturi section 5. In this embodiment of the invention, the flow rate of air which is delivered via the duct 25 into the carburetor 1 is inversely proportional to the flow rate of the exhaust gas delivered into the carburetor 1 via the recirculation line 6, since the recirculated exhaust gas is at a generally higher pressure than that of the air in the supplementary air duct 25, delivery of air from the duct 25 into the carburetor 1 being completely or almost completely stopped at high flow rates of the exhaust gas in the recirculation line 6, whereby there is automatic enrichment of the air-fuel mixture produced in the carburetor 1 as the exhaust gas recirculation ratio is increased. To ensure a correct supply of the exhaust gas into the carburetor 1, there is suitably provided in the supplementary air duct 25 an orifice element 25*a* which has a smaller cross-sectional area than that of the delivery end 6*a* of the recirculation line 6, whereby the duct 25 presents a greater resistance to flow.

In all of the above described embodiments of the invention, the stop valves 15 and 22 may, of course, be directly positioned in the recirculation lines 6 and 7, respectively. The diaphragm units 11 and 20 are preferably included, however, since, as noted earlier, by the connection of the ducts 14 and 21 to a source in which the value of pressure is related to intake air pressure in the carburetor 1, the rate of exhaust gas recirculation can be varied in relation to operating conditions of the engine E.

Although the present invention has fully been described in connection with the preferred embodiments thereof with reference to the accompanying drawings, it is to be noted that various changes and modifications will be apparent to those skilled in the art. Such changes and modifications are to be construed being included within the true scope of the present invention unless they depart therefrom.

What is claimed is:

1. In an internal combustion engine having a carburetor including at least a venturi section, a fuel introduction system for introduction of fuel into air passing through said venturi section, and a throttle valve provided downstream of said venturi section, at least one combustion chamber to which the air-fuel mixture is supplied from said carburetor and in which the air-fuel mixture is burned, and exhaust pipe means for exhausting the gases of combustion from said combustion chamber, exhaust gas recirculation means comprising:

a take-off line from said exhaust pipe for taking off of a portion of said exhaust gas flowing in said exhaust pipe means;

a first recirculation line into which exhaust gas is supplied by said take-off line having a delivery end connected to a portion of said carburetor which is intermediate said venturi section and said throttle valve;

a second recirculation line into which exhaust gas is supplied by said take-off line and having a delivery end connected to a portion of said carburetor which is downstream of said throttle valve;

a first recirculation line closure means in said first recirculation line;

a second recirculation line closure means in said second recirculation line;

control means connected to the respective closure means and for receiving as an input at least one signal from among a first signal indicating that the vehicle speed is above a certain value, a second signal indicating that the engine load is above a certain value, a third signal indicating that the engine speed is above a certain value, and for causing said first recirculation line closure means to close said first recirculation line upon receipt of any one of said signals; and a supplementary air duct having an inlet end communicating with a portion of said carburetor which is upstream of said venturi section and an outlet end communicating with the interior of said first recirculation line.

2. Exhaust gas recirculation means as claimed in claim 1, wherein each said recirculation line closure means comprises a flow control valve able to throttle or stop the flow of exhaust gas in said recirculation line;

a diaphragm unit comprising a diaphragm which divides said diaphragm unit into a constant pressure chamber and a negative pressure chamber and which is connected to and controls the position of said flow control valve; spring means exerting on said diaphragm a force which acts constantly to cause said diaphragm to move said flow control valve to a closed position and is opposed by a force resulting from the difference of pressure in said chambers of said diaphragm unit, and a duct connecting said negative pressure chamber to a negative pressure source; and a stop valve which is provided on said duct and is controlled by said control means.

3. Exhaust gas recirculation means as claimed in claim 1, wherein said input suppliable to said control means further includes a signal which indicates that said engine is warmed-up, and said control causes said first and second recirculation line closure means to close said first and second recirculation lines in response to said input.

4. Exhaust gas recirculation means as claimed in claim 1, further comprising means for supplying to said control means a fourth signal which indicates that the temperature of air at the intake portion of said carburetor is below a certain value, and said control means is connected to said first recirculation line closure means for closing said first recirculation line in response to said fourth signal.

* * * * *